US007079081B2

(12) United States Patent
Parsche et al.

(10) Patent No.: US 7,079,081 B2
(45) Date of Patent: Jul. 18, 2006

(54) SLOTTED CYLINDER ANTENNA

(75) Inventors: Francis E. Parsche, Palm Bay, FL (US); Brian J. Haman, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 113 days.

(21) Appl. No.: 10/619,299

(22) Filed: Jul. 14, 2003

(65) Prior Publication Data

US 2005/0012673 A1 Jan. 20, 2005

(51) Int. Cl.
*H01Q 13/10* (2006.01)
*H01Q 1/24* (2006.01)

(52) U.S. Cl. ..... 343/767; 343/702

(58) Field of Classification Search ..... 343/702, 343/767, 768, 745, 746, 749
See application file for complete search history.

(56) References Cited

U.S. PATENT DOCUMENTS 3,560,978 A * 2/1971 Himmel et al. ..... 342/399
3,790,942 A * 2/1974 Becavin et al. ..... 342/398
4,047,179 A * 9/1977 Appelbaum et al. ..... 343/768
4,260,994 A * 4/1981 Parker ..... 342/368
5,955,997 A 9/1999 Ho et al.
5,977,924 A * 11/1999 Takei et al. ..... 343/770
6,034,644 A * 3/2000 Okabe et al. ..... 343/767
6,104,349 A * 8/2000 Cohen ..... 343/702
6,166,701 A * 12/2000 Park et al. ..... 343/771
6,462,714 B1 * 10/2002 Okabe et al. ..... 343/767
2003/0011522 A1 * 1/2003 McKinzie et al. ... 343/700 MS

* cited by examiner

*Primary Examiner*—Shih-Chao Chen
*Assistant Examiner*—Minh Dieu A
(74) *Attorney, Agent, or Firm*—Sacco & Associates, PA

(57) ABSTRACT

An antenna (100) for RF communications. The antenna includes a radiating member (102) which is substantially tubular so as to define a cavity (104) therein. The radiating member (102) is made of a conductive material having a non-conductive slot (106) extending from a first portion (108) of the radiating member (102) to a second portion (110). An impedance matching device (120) is electrically connected to the radiating member (102) via a conductor (134) to match an impedance of the radiating member (102) with an impedance of a signal source or an impedance of a load. The impedance matching device (120), the conductor (134), and at least a portion of the radiating member radiating element (102) can formed from a single conductive sheet, or molded or extruded as a single conductive structure.

23 Claims, 3 Drawing Sheets

SLOTTED CYLINDER ANTENNA

STATEMENT REGARDING FEDERALLY SPONSORED RESEARCH OR DEVELOPMENT

The United States Government has rights in this invention pursuant to Contract No. 02-C-5030.

BACKGROUND OF THE INVENTION

1. Statement of the Technical Field

The invention concerns dielectric substrates for RF circuits, and more particularly dielectric substrates with effective permittivity values that can be independently controlled in predetermined portions of the substrate.

2. Description of the Related Art

The use of mobile telephones, such as cellular telephones, has become pervasive throughout much of the world. While being operated, most modern cellular telephones are held very close to the human body, for example next to a user's ear or on the user's belt. Cellular telephones typically interface with communications networks by receiving and transmitting low power RF signals through a dipole antenna. However, such signals are often disrupted by the proximity of the antenna to the human body. In particular, current state of the art antennas produce near electric fields that couple to the polar water molecules in human tissue, thereby reducing signal strength. For example, human tissue can attenuate a 960 MHz RF signal transmitted by a conventional dipole antenna at a rate of 6 dB per inch.

Further, many experts believe that the interaction of the RF signals with a person's tissue can have dangerous health risks. Some contend that the RF signals can interfere with the body's natural electrical systems. This reaction can vary depending on the individual, but there is speculation that the RF signals can harm a person's immune system and spur cancer development. It also has been alleged that RF signals from cellular telephones can interfere with brain activity, accounting for the symptoms of memory loss, changes in blood pressure, anxiety and lack of concentration. Accordingly, there exists a need for an antenna that can be used in mobile communications systems to improve RF signal propagation and reduce the interaction between RF signals and the human body. Moreover, there exists a need for an antenna that will operate with low VSWR, stable tuned frequency, and high efficiency when the antenna operates near water and moist soils.

SUMMARY OF THE INVENTION

The present invention relates to an antenna for RF communications. The antenna includes a radiating member that is substantially tubular so as to define a cavity therein. The radiating member is made of a conductive material having a non-conductive slot extending from a first portion of the radiating member to a second portion. For example, the non-conductive slot can extend along a length of the tubular structure.

An impedance matching device is electrically connected to the radiating member to match an impedance of the radiating member with an impedance of a signal source or an impedance of a load. The impedance matching device can be connected to the second portion of the radiating member. In one embodiment, the impedance matching device can include a transverse electromagnetic (TEM) feed coupler A conductor operatively connects the radiating member to the impedance matching device. The impedance matching device, the conductor, and at least a portion of the radiating element can formed from a single conductive sheet, or molded or extruded as a single conductive structure. Further, the impedance matching device and the radiating element can have a common cross sectional profile.

The antenna can further include at least one capacitor that includes at least a first conductive lead and a second conductive lead. The first conductive lead can be connected to the radiating member proximate to a first side of the non-conductive slot, and the second conductive lead can be connected to the radiating member proximate to a second side of the non-conductive slot. In one arrangement, the capacitor can be a variable capacitor. The field impedance of the antenna can be less than $0\pm2$ j ohms. The absolute value of the field impedance of the antenna also can be less than 2 ohms, 5 ohms, 10 ohms, 25 ohms or 50 ohms.

The antenna can be arranged to produce a cardioid radiation pattern which has a radiation pattern having a general form of $(1-\cos^2\theta)$. A null associated with the cardioid radiation pattern can be oriented toward a human body.

The antenna further can include an electrostatic shield member. The electrostatic shield member can have an axial slot extending from a first end of the electrostatic shield member to a second end of the electrostatic shield member.

DETAILED DESCRIPTION OF THE PREFERRED EMBODIMENTS

The present invention relates to a compact slotted cylinder antenna, which may be configured to have an omni-directional radiation pattern, a cardioid radiation pattern, or a hybrid of the two. The near field impedance of the antenna is significantly lower than the impedance of human tissue. Accordingly, the antenna can be operated in proximity to a human body without significant coupling between the antenna and the body. In consequence, the risk of harmful side effects on the body due to radio frequency (RF) energy propagated by the antenna is minimized.

Further, radiation pattern nulls which can be caused by the human body are substantially reduced in comparison to other types of antennas. Specifically, the E-field component of the far fields produced by the slotted cylinder antenna are oriented substantially normal to the human body. In consequence, a portion of the far fields from the slotted cylinder antenna are guided along the surface of the body until they reach the side of the body opposite from the point of incidence. Accordingly, the depth of the radiation pattern null caused by the shadow of the human body is reduced.

The conductivity (G) and relative permeability ($\mu_r$) of the human body, which are approximately 1.0 mho/square and 50, respectively, cause surface wave propagation along the body. Surface wave propagation is well known to those skilled in the art.

Figure 1:
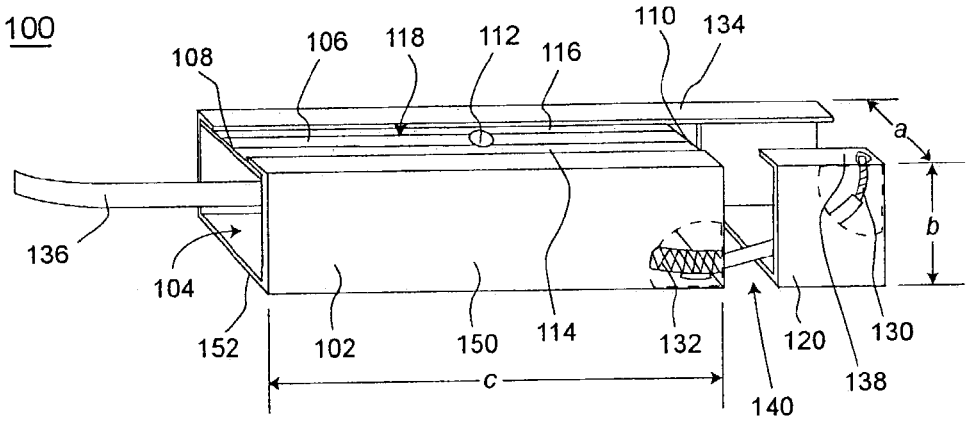
FIG. 1 is a perspective view of a slotted cylinder antenna that is useful for understanding the present invention.

Referring to FIG. 1, a perspective view of an antenna 100 is shown. The antenna 100 can include a radiating member 102. The radiating member 102 can be made from an electrically conductive material, for example copper, brass, aluminum, steel, conductive foil, conductive plating, and/or any other suitable material. Further, the radiating member 102 can be substantially tubular so as to provide a cavity 104 at least partially bounded by the conductive material. As defined herein, the term tubular describes a shape of a hollow structure having any cross sectional profile. In the present example, the radiating member 102 has a rectangular cross sectional profile, however, the present invention is not so limited. Importantly, the radiating member 102 can have any shape which can define a cavity 104 therein. For example, the radiating member 102 can have a cross sectional profile that is round, square, triangular, or any other suitable shape. Additionally, the radiating member 102 may be either evanescent or resonant.

The radiating member 102 can include a non-conductive slot (slot) 106. The slot 106 can extend from a first portion of the radiating member 102 to a second portion of the radiating member 102. For instance, the slot 106 can extend from a first end 108 of the radiating member 102 to a second end 110 of the radiating member 102. At least one capacitor 112 can be disposed between opposing sides 114, 116 of the slot 106 to increase capacitance across the slot 106, which can reduce the resonant frequency of the radiating member 102. In a preferred arrangement, the capacitor 112 can be adjustable to provide the capability to tune the resonant frequency of the antenna 100, as discussed below.

Other methods also can be used to tune the resonant frequency of the antenna. For instance, holes can be drilled in the radiating member 102. In another alternative arrangement, a metal disk can be positioned in the center of radiating member 102. To tune the resonant frequency of the antenna, the plane of the disk can be rotated to shade or partially shade the aperture of the cavity member 102.

The radiating member 102 and/or the slot 106 can be dimensioned to radiate RF signals. The strength of signals propagated by the radiating member 102 can be increased by maximizing the cross sectional area of the cavity 104, in the dimensions normal to the axis of the radiating member 102. Further, the strength of signals propagated by the slot 106 can be increased by increasing the length of slot 106. Accordingly, the area of the cavity cross section and the length of the slot can be selected to achieve a desired radiation pattern. For example, the slot 106 and circumference of the radiating member 102 can be dimensioned to radiate a single lobed cardioid ($D_\theta=1-\cos^2\theta$) pattern, a circular ($D_\theta$=constant) omnidirectional pattern, or a hybrid of the two. Such radiation patterns can be oriented about the axis of the radiating member 102. In one exemplary arrangement, a cardioid radiation pattern can be produced by providing the radiating member 102 with a width a approximately equal to ½ λ, a depth b approximately equal to 1/20 λ, and a length c approximately equal to ½ λ, where λ is a wavelength of a signal at the operational frequency of the radiating member 102.

The ($D_\theta=1-\cos^2\theta$) cardioid radiation pattern in particular can minimize coupling of RF signals. Such a radiation pattern produces a null when the angle θ is approximately zero. The radiation pattern null can be directed towards a human, for instance an operator of a wireless communication device, to minimize coupling of RF signals to the human's body. The cardioid pattern also can be used to enhance antenna efficiency by directing RF signals away from the body. A portion of these RF signals could otherwise be dissipated in the tissue of the body.

The antenna 100 also can include an impedance matching device 120 disposed to match an impedance of the radiating member 102 with the impedance of a signal source and/or the impedance of a load (not shown). For instance, the impedance matching device can match the impedance of the radiating member 102 to a transceiver. According to one aspect of the invention, the impedance matching device 120 can be a transverse electromagnetic (TEM) feed coupler. Advantageously, a TEM feed coupler can compensate for resistance changes caused by changes in operational frequency and provide constant driving point impedance, regardless of the frequency of operation. For example, the driving point impedance can be maintained at the appropriate impedance, for instance 50 ohms, to match the impedance of a transceiver. A single control tuning effect is thus realized, and broad bandwidth tuning is possible with low VSWR, solely by variation of the capacitor 202. Nonetheless, other suitable impedance matching devices can be used to match the parallel impedances of the radiating member 102 to a source and/or load and the invention is not so limited. For example induction loops, gamma match structures or any other device which can match the impedance of the radiating member 102 to a transciever.

In the case that the impedance matching device 120 is a TEM feed coupler, the impedance matching performance of the TEM coupler is determined by the electric (E) field and magnetic (H) field coupling between the TEM coupler and the radiating member 102. The E and H field coupling, in turn, is a function of the respective dimensions of the TEM coupler and the radiating member 102, and the relative spacing between the two structures.

The impedance matching device 120 can be operatively connected to a source and/or load via a first conductor 130. For example, the first conductor 130 can be a conductor of a suitable cable, for instance a center conductor of a coaxial cable 136. In the case that the impedance matching device 120 is a TEM coupler, the first conductor 130 can be electrically connected to a side 138 of the TEM coupler which is distal from a second conductor 134 which operatively connects the TEM coupler to the radiating member 102. Further, a third conductor 132 can operatively connect the radiating member 102 to the source and/or load. For example, the third conductor 132 can be an outer conductor of the coaxial cable 136. The third conductor 132 can be electrically connected to the radiating member 102 proximate to the gap 140 between the radiating member 102 and the impedance matching device 120. In one arrangement, the third conductor 132 can be electrically connected to the radiating member 132 as shown. Alternatively, the conductor 132 can be electrically connected to a slotted member 118, which can form a portion of the radiating member 102. The positions of where third conductor 132 and first conductor 130 are electrically connected to the respective radiating member can be selected to achieve a desired load/source impedance of the antenna.

Current flowing between the first conductor 130 and the third conductor 132 can generate the H field coupling the impedance matching device 120 and the radiating member 102. Further, an electric potential difference between the impedance matching device 120 and the radiating member 102 can generate the E field coupling. The amount of E field and H field coupling decreases as the spacing between the impedance matching device 120 and the radiating member 102 is increased. Accordingly, a gap 140 can be adjusted to achieve the proper levels E field and H field coupling. The size of the gap 140 can be determined empirically or using a computer program incorporating finite element analysis for electromagnetic parameters.

In a preferred arrangement, the impedance matching device 120, the second conductor 134, and at least a portion of the radiating member 102 can be formed from a single conductive sheet, molded as a single conductive structure, or extruded as a single conductive structure. Moreover, the impedance matching device 120 can have a cross sectional profile which is similar or identical to the cross sectional profile of the radiating member 102. For example, the impedance matching device 120 and the radiating member 102 can have at least one common dimension. In one arrangement, the impedance matching device 120 and the radiating member 102 can have two common dimensions, for instance width a and depth b. Such an arrangement can be very cost effective as the number manufacturing steps required to manufacture the antenna 100 can be minimized.

The coaxial cable 136 can be disposed to feed through the cavity 104 of the radiating member 102. Accordingly, the radiating member 102 can operate as a sleeve balun for the coaxial cable, shielding the coaxial cable 136 from displacement currents and reducing common mode currents on the coaxial cable 136. Further, the coaxial cable can enter the cavity 104 near the first end 108 of the r radiating member 102 while the impedance matching device 120 is disposed proximate to the second end 110 of the radiating member 102 Such a configuration can minimize stray capacitance between the third conductor 132 and the impedance matching device 120, thereby further reducing common mode currents on the coaxial cable. Accordingly, the use of additional baluns to control radio frequency interference can be avoided.

In an alternate arrangement, in lieu of the impedance matching device 120, the radiating member 102 may be directly excited by an impedance matching device formed by providing a feed line (not shown) across an additional slot (not shown) within the radiating member 102. For example, the additional slot can be located on a second side 152 of the radiating member 102, opposite the slot 106. The feed line feed line can be connected across the additional slot to form a discontinuity feed. Notably, one or more capacitors can be operatively connected in parallel with the discontinuity feed to form a matching network. Accordingly, the value of the capacitors can be selected to achieve a desired driving point impedance for the antenna 100. For instance, capacitors can be selected which, together with the discontinuity feed, provide a driving point impedance of 50 ohms.

Figure 2A:
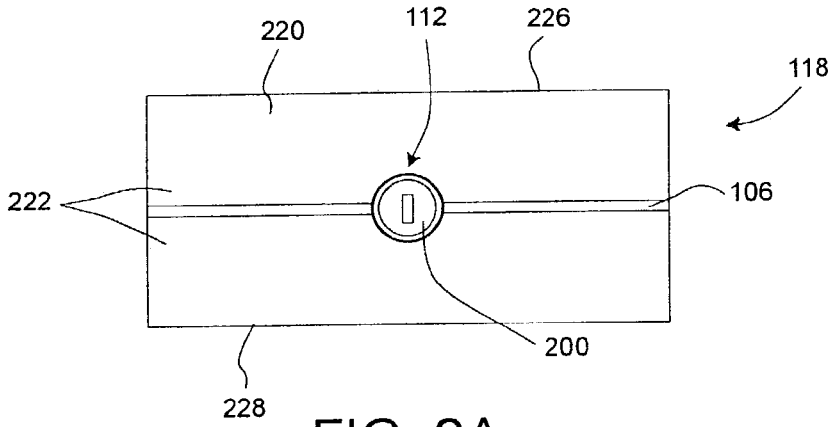
FIG. 2A is a top view of a slotted member of the antenna in FIG. 1.
Figure 2B:
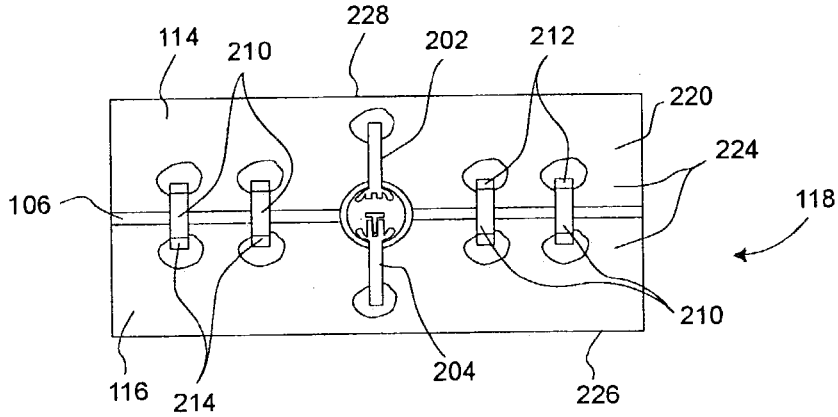
FIG. 2B is a bottom view of the slotted member of the antenna in FIG. 1.

The slotted member 118 can include the slot 106 is shown in FIGS. 2A and 2B. FIG. 2A is a top view of the slotted member 118. As noted, the capacitor 112 can be a variable capacitor to provide variable capacitance across the slot 106. Accordingly, the capacitor 112 can be provided with an adjustment screw 200.

Referring to FIG. 2B, a bottom view of the slotted member 118 is shown. The capacitor 112 can include first and second conductive leads (leads) 202, 204 to connect the capacitor 112 to the opposing conductive surfaces of the slotted member 118. For example, the leads 202, 204 can be soldered to respective opposing sides 114, 116. Additional capacitors 210 having leads 212, 214 also can be provided to further increase the capacitance across the slot 106. Again, the leads 212, 214 can be soldered to the opposing sides 114, 116.

The slotted member 118 can be fabricated as an integral part of the radiating member 102, for example during a fabrication, extrusion or casting process. However, to simplify fabrication of the antenna, the slotted member 118 can be provided as a separate antenna section which is fixed to the remaining portion of the radiating member 102 after the capacitors 112, 210 are connected. Accordingly, the capacitors 112, 210 can be easily accessible during assembly of the antenna 100. Once the capacitors 112, 210 have been installed, the slotted member 118 can be fixed to the radiating member. The slotted member 118 can be installed using any one of a myriad of techniques. For example, the slotted member 118 can be soldered into place, screwed into place, or glued into place using conductive glue, such as conductive epoxy.

To further reduce manufacturing costs, the slotted member 118 can comprise a dielectric substrate 220 having a conductive metallization thereon. For instance, referring to FIGS. 2A and 2B, a top surface 222 and a bottom surface 224 of the slotted member can be metalized. Further, edges 226, 228 can be metalized to provide electrical continuity between the top and bottom surfaces 222, 224. The slot 106 can be a portion of the dielectric substrate 220 which is left unmetalized on both the top and bottom surfaces 222, 224, or etched after the metallization process.

Figure 3:
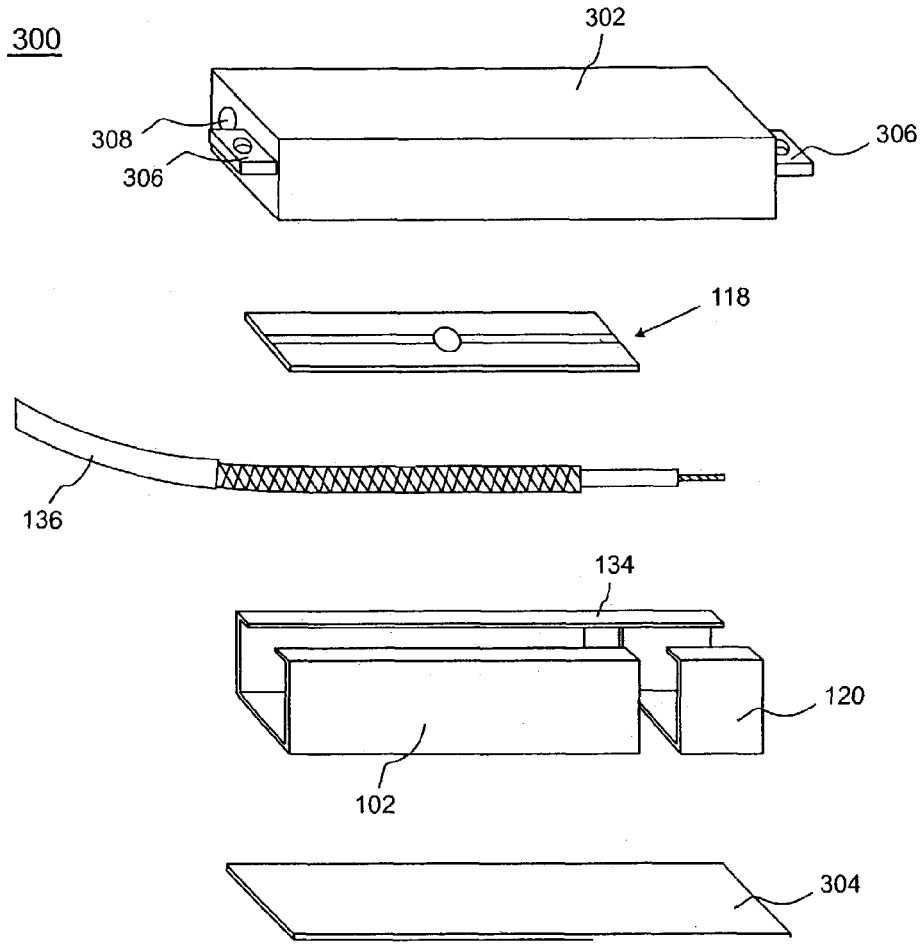
FIG. 3 is an exploded view of the antenna in FIG. 1.
Figure 4:
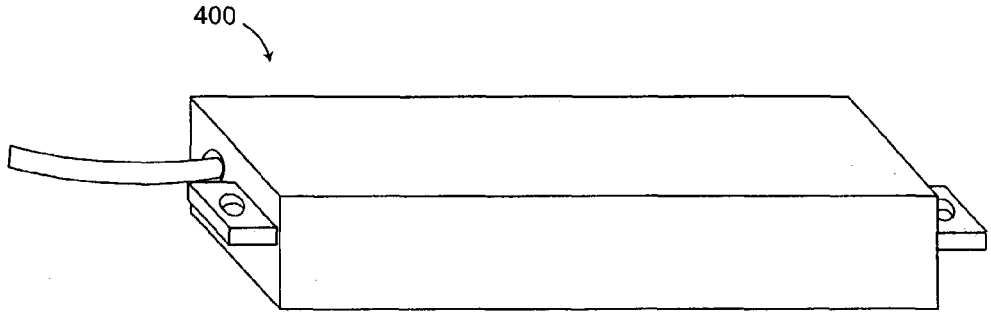
FIG. 4 is a perspective view of an exemplary antenna housing for the antenna in FIG. 1.

An exploded view 300 of an antenna assembly is shown in FIG. 3. In addition to the radiating member 102, impedance matching device 120, conductor 134, cable 136 and slotted element 118, the antenna assembly can further include an antenna casing 302 and cover 304. In the preferred arrangement, the antenna casing 302 and cover 304 can be fabricated from a dielectric material. Further, the antenna casing 302 can include mounting tabs 306 and an aperture 308 through which the cable 136 can be disposed. Notably, the relative permittivity and relative permeability of the antenna casing 302 and cover 304 should be considered when designing the antenna to insure proper antenna propagation characteristics. An enclosed antenna 400 wherein the antenna is assembled in the casing 302 is shown in FIG. 4.

Figure 5A:
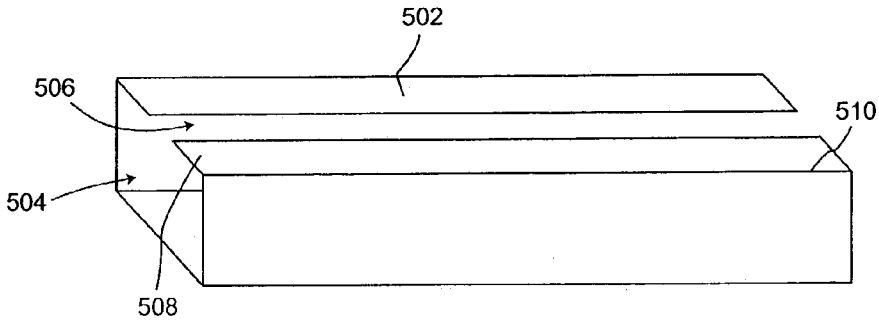
FIG. 5A is a perspective view of an exemplary electrostatic shield which can be attached to a slotted cylinder antenna.

Referring to FIG. 5A, the antenna 400 also can include an electrostatic shield member 502. The electrostatic shield member 502 can be made from an electrically conductive material, for example copper, brass, aluminum, steel, conductive foil, conductive plating, and/or any other suitable material. Further, the electrostatic shield member 502 can be substantially tubular so as to provide a cavity 504 at least partially bounded by the conductive material. In another arrangement, the electrostatic shield member 502 is realized by providing a conductive coating, conductive plating, or conductive foil on the antenna casing 302. The electrostatic shield member 502 can include an axial slot 506 extending from a first end 508 of the electrostatic shield member 502 to a second end 510 of the electrostatic shield member. The slot 506 can prevent the electrostatic shield member 502 from providing a circumferentially continuous circuit around the antenna 400. Such a circumferentially continuous circuit can degrade the performance of the antenna 400. In a preferred arrangement, the slot 506 is disposed to be proximate to the slot provided in the slot of the radiating member.

Figure 5B:
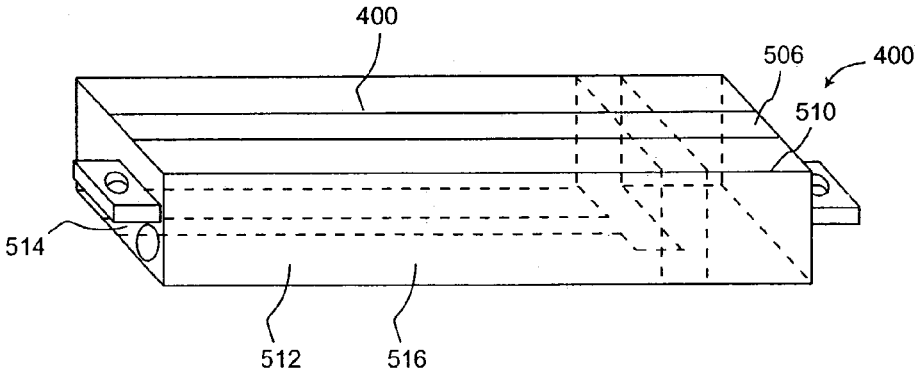
FIG. 5B is a perspective view of the electrostatic shield of claim 5A wherein the electrostatic shield is attached to a slotted cylinder antenna.

The electrostatic shield member 502 optionally can be employed to further enhance the tuning stability of the antenna 400 by preventing parasitic capacitance from loading the slot, which can change the resonant frequency of the antenna. Parasitic capacitance can be caused by the proximity of antenna 400 to metals or other materials of high electrical conductivity. In a preferred configuration, as shown in FIG. 5B, the slot 506 of the shield member 502 is arranged so that the slot 506 is disposed on an opposite side 510 of the antenna 400 from a side where the slot 514 of the radiating member 516 is disposed.

Antenna Operation

Referring again to FIGS. 1, 2A and 2B, the operation of the antenna 100 will now be described. Optimum antenna performance is obtained at the frequency at which antenna 100 resonates. The resonant frequency is a function of the inductive and capacitive loading of the slot 106. The cavity 104 may be evanescent and can inductively load the slot 106, while the slot 106 is capacitively loaded by the capacitance between the opposing sides 114, 116. The value of the inductive load L across the slot 106 can be computed using the dimensions of the radiating member 102. For example, in the case that the radiating member 102 has a rectangular cross section, the inductive load can be determined by the equation $L=0.02339\ [(s_1+s_2)\ \log_{10}\ (2\ s_1\ s_2/b+c)-s_1\ \log_{10}\ (s_1+g)-s_2\ \log_{10}\ (s_2+g)]+0.01010\ [2\ g-(s_1+s_2)/2+0.447\ (b+c)]$, where L is given in microhenries, $s_1$ is a width of a first side 150 of the radiating member 102, $s_2$ is a width of the second side 152 of the radiating member 102, c is a length of the radiating member 102 measured from the first end 108 of the radiating member to the second end 110 of the radiating member 102, b is a wall thickness of the radiating member 102, and g is a diagonal length across the cross section of the cavity 104. Alternatively, the inductive load L can be determined using a computer program which performs electromagnetic field and wave analysis using the Periodic Moment Method, or empirically determined. For example, a known capacitance $C_K$ can be connected across the slot 106 and the resonant frequency of the antenna 100 can be measured. The inductive load L then can be computed using the equation $$L = \frac{1}{4\pi^2 f^2 C_K}.$$

The resonant frequency (f) of the antenna 100 can be computed by the equation $$f = \frac{1}{2\pi\sqrt{LC}},$$

where L is the inductive load provided by the cavity 104 and C is the capacitance across the slot 106. As noted, capacitors 112 and/or 210 can be provided to increase the capacitance across the slot 106 to achieve a desired resonant frequency. For example, the capacitance can be increased to decrease the resonant frequency, or the capacitance can be decreased to increase the resonant frequency. In the preferred arrangement, the capacitor 112 can be provided with enough adjustment to vary the resonant frequency of the antenna 100 over multiple octaves.

Notably, the capacitor 112 and/or capacitors 210 can enable the antenna 100 to operate efficiently at a frequency which is significantly lower than an antenna not having such capacitors across the slot 106. For example, without the capacitors, the antenna would require a large ¼ or ½ wave self-resonant cavity. In some applications, such a cavity would interfere with the antenna propagation pattern and cause nulls in certain propagation directions. However, the capacitors 112 and/or capacitors 210 can enable the cavity 104 to be significantly smaller than a ¼ or ½ wave self resonant cavity. Accordingly, the size of the cavity 104 is small in comparison to the wavelength of the RF signals and hence does not cause a significant null in any propagations directions. Moreover, the antenna 100 can be manufactured small enough to be optimized for use in portable communication devices, such as cellular telephones, beepers, personal digital assistants, or any other device requiring an antenna, especially one which is physically small.

Radiating member 102 may be reduced in size by the inclusion of ferromagnetic, paramagnetic or dielectric materials within the cavity 104. In particular, the propagation velocity of an electromagnetic signal is inversely proportional to $\sqrt{\mu\epsilon}$, where $\mu$ is the permeability and $\epsilon$ is the permittivity of the medium through which the signal is propagating. Accordingly, as the permeability or permittivity is increased, the propagation velocity of a signal decreases, which reduces the wavelength of the signal for any given frequency. Thus, increasing the permeability and/or permittivity within the cavity 104 increases the electrical size of the cavity, and thus reduces the cavities resonant frequency.

There are a myriad of materials commercially available which can be used to increase the permeability and/or permittivity in the region defined by the cavity 106. For instance, ferrite, iron powder, or any other ferrous material can be disposed within the cavity to increase the permeability within the cavity. Further, polypropylene, polyester, polycarbonate, polystyrene, alumina, ceramics, dielectric fluids, or any other dielectric material having a dielectric constant greater than 1 can be disposed within the cavity 106 to increase the permittivity.

In some instances it may be desirable to achieve a desired characteristic impedance within the cavity 106. The characteristic impedance of a medium can be determined by the equation $\sqrt{\mu/\epsilon}$. Accordingly, in the case that the dielectric cavity is filled with one or more materials, materials can be selected which provide an appropriate permeability and/or permittivity to achieve the desired characteristic impedance. In one arrangement, a variety of materials can mixed to achieve a desired permeability and permittivity. For example, ferromagnetic particles can be mixed with dielectric particles. An example of such a material is an isoimpedance material, which has a relative permittivity equal to its relative permeability.

In a preferred arrangement, the impedance between opposing sides 114, 116 of the slot 106 is low. For example, the impedance between the opposing sides 114, 116 can be less than 30 milliohms, which can be achieved by providing a radiating member 102 which is electrically conductive. In such a case, even though capacitors are provided across the slot 106, most of the current flow between the opposing sides 114, 116 propagates through the conductive structure of the radiating member 102.

Having a low impedance between opposing sides 114, 116 of the slot 106 can result in a low voltage potential across the slot 106 when a signal is applied to the antenna 100, which correspondingly results in a small E-field component of the signal being propagated. Low impedance between opposing sides 114, 116 also can result in an appreciable amount of current flow in the structure of the radiating member 102, thereby resulting in a significant H-field component. In consequence, the near field impedance ($Z_{NF}$) of the antenna, which is given by the equation $Z_{NF}$=E/H, is low. For example, the near field impedance can be less than about 0±2 j ohms, and thus is significantly less than the impedance of human tissue, which has a relative permittivity near 50 and a relative permeability slightly less than 1. The near field impedance also can have an absolute value less than 2 ohms, 5 ohms, 10 ohms, 25 ohms or 50 ohms.

Since the relative permittivity of human tissue is significantly higher than the relative permeability, human tissue is much more susceptible to energy contained in an E-field than energy contained in an H-field. Accordingly, an RF signal having a low near field impedance (small E-field component and large H-field component) will have much less interaction with the human body than a high impedance RF signal (large E-field component and small H-field component) having the same amount of energy. Accordingly, the antenna 100 can be operated in proximity to a human body with significantly reduced coupling between the antenna 100 and the body in comparison to conventional dipole antennas. In consequence, the risk of harmful side effects on the body due to radio frequency (RF) energy propagated by the antenna is minimized. Further, nulls in the RF propagation pattern caused by the human body are substantially reduced.

In addition to personal communication applications, the slotted cylinder antenna of the present invention can be used for a wide range of applications, for instance applications operating from the very low frequency (VLF) band up into the super high frequency (SHF) band. Of course, the size of the antenna should be selected for proper operation at the desired frequency. Notably, antennas for use at frequencies from the VLF band up into the high frequency (HF) band tend to be physically large and difficult to elevate. In consequence, such antennas are typically installed and operated near moist soils or bodies of water. Because the slotted cylinder antenna of the present invention operates with a low near field impedance, the antenna can operate near the soil or water with high radiation efficiency and tuning stability, without the need for grounding systems or a metallic counterpoise.

Another advantage of the low near field impedance design is that it makes the voltage standing wave ration (VSWR) of the antenna much more stable in the presence of icing. Specifically, ice is a dielectric having a relatively high permittivity and low permeability. For instance, the relative permittivity of ice can be higher than 3, while the permeability of ice can be approximately 1. As such, ice stores much E-field energy, but interacts insignificantly with H-fields. Hence, although ice can severely degrade the performance of an antenna having a high near field impedance, ice does not significantly effect the performance of the antenna 100 since it can be adjusted to have a low near field impedance. This feature can be very beneficial for use in cold climates, especially for use as a television transmitting antenna, for which low VSWR performance is essential. In particular, no deicing radome is required for use with the present invention to compensate for ice formation proximate to the antenna 100.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. An antenna for RF communications comprising:

a radiating member comprising an electrically conductive material and having a slot extending from a first portion of said radiating member to a second portion of said radiating member, said radiating member being substantially tubular and defining a cavity therein;

an impedance matching device electrically connected to said radiating member, said impedance matching device disposed to match an impedance of said radiating member with at least one impedance selected from the group consisting of an impedance of a signal source and an impedance of a load; and a conductor operatively connecting said radiating member to said impedance matching device;

wherein said impedance matching device, said conductor, and at least a portion of said radiating member are integrally formed from a single conductive sheet.

2. The antenna of claim 1, wherein said non-conductive slot extends along a length of said radiating member.

3. The antenna of claim 1, wherein said radiating member and said impedance matching device have a common cross sectional profile.

4. The antenna of claim 1, further comprising at least one capacitor comprising at least a first conductive lead and a second conductive lead, said first conductive lead being connected to said radiating member proximate to a first side of said non-conductive slot, and said second conductive lead being connected to said radiating member proximate to a second side of said non-conductive slot.

5. The antenna of claim 4, wherein said at least one capacitor is a variable capacitor.

6. The antenna of claim 1, wherein said impedance matching device is connected to said second portion of said radiating member.

7. The antenna of claim 1, wherein said impedance matching device comprises a transverse electromagnetic feed coupler.

8. The antenna of claim 1, wherein a field impedance of said antenna is less than about 0±2 j ohms.

9. The antenna of claim 1, wherein an absolute value of a field impedance of said antenna is less than 5 ohms.

10. The antenna of claim 1, further comprising an electrostatic shield member, said electrostatic shield member having an axial slot extending from a first end of said electrostatic shield member to a second end of said electrostatic shield member.

11. The antenna of claim 1, wherein said antenna is arranged to produce a lobed cardloid radiation pattern.

12. An antenna for RF communications comprising:

a radiating member comprising an electrically conductive material, said radiating member being substantially tubular and defining a cavity therein;

a non-conductive slot extending from a first portion of said radiating member to a second portion of said radiating member; and an impedance matching device electrically connected to said radiating member, said impedance matching device disposed to match an impedance of said radiating member with at least one impedance selected from the group consisting of an impedance of a signal source and an impedance of a load;

wherein an absolute value of a field impedance associated with said antenna is substantially less than 50 ohms.

13. The antenna of claim 12 wherein the field impedance of said antenna is less than about 0±2j ohms.

14. The antenna of claim 12 wherein the absolute value of the field impedance of said antenna is less than 5 ohms.

15. The antenna of claim 12, further comprising at least one capacitor comprising at least a first conductive lead and a second conductive lead, said first conductive lead being connected to said radiating member proximate to a first side of said non-conductive slot, and said second conductive lead being connected to said radiating member proximate to a second side of said non-conductive slot.

16. The antenna of claim 15, wherein said at least one capacitor is a variable capacitor.

17. The antenna of claim 12, wherein said impedance matching device is connected to said second portion of said radiating member.

18. The antenna of claim 12, wherein said impedance matching device comprises a transverse electromagnetic (TEM) feed coupler.

19. An antenna for RF communications comprising:

a radiating member comprising an electrically conductive material, said radiating member being substantially tubular and defining a cavity therein;

a non-conductive slot extending from a first portion of said radiating member to a second portion of said radiating member;

an impedance matching device electrically connected to said radiating member, said impedance matching device disposed to match an impedance of said radiating member with at least one impedance selected from the group consisting of an impedance of a signal source and an impedance of a load; and a conductor operatively connecting said radiating member to said impedance matching device;

wherein said impedance matching device, said conductor, and at least a portion of said radiating member are integrally formed from a single conductive structure.

20. The antenna of claim 19, wherein said single conductive structure is formed by at least one process selected from the group consisting of a casting process and an extrusion process.

21. The antenna of claim 19, wherein said non-conductive slot extends along a length of said radiating member.

22. The antenna of claim 19, wherein said radiating member and said impedance matching device have a common cross sectional profile.

23. An antenna for a mobile RF communications device comprising a single radiation element, said single radiation element comprising a continuous sheet of an electrically conductive material and having a slot extending from a first portion of said radiation element to a second portion of said radiation element, said continuous sheet of said radiation element shaped to define a substantially tubular form and defining a cavity therein, wherein a radiation pattern produced by said single radiation element is a lobed cardloid radiation pattern.

* * * * *

UNITED STATES PATENT AND TRADEMARK OFFICE

CERTIFICATE OF CORRECTION

PATENT NO. : 7,079,081 B2
APPLICATION NO. : 10/619299
DATED : July 18, 2006
INVENTOR(S) : Parsche et al.

It is certified that error appears in the above-identified patent and that said Letters Patent is hereby corrected as shown below:

Column 1
Line 65, after “coupler” insert --.--.

Column 10
Line 45 claim 11, after “lobed” delete “cardloid” and replace with --cardioid--.

Column 12
Line 24 claim 23, after “lobed” delete “cardloid” and replace with --cardioid--.

Signed and Sealed this

Sixth Day of November, 2007

JON W. DUDAS
*Director of the United States Patent and Trademark Office*